United States Patent [19]

Johansson

[11] 4,348,558

[45] Sep. 7, 1982

[54] DIVERTER SWITCH FOR AN ON-LOAD TRANSFORMER TAP CHANGER

[75] Inventor: Folke Johansson, Ludvika, Sweden

[73] Assignee: ASEA Aktiebolag, Vasteras, Sweden

[21] Appl. No.: 107,763

[22] Filed: Dec. 28, 1979

[30] Foreign Application Priority Data

Jan. 5, 1979 [SE] Sweden ..... 7900091

[51] Int. Cl.[3] ..... H01H 3/32

[52] U.S. Cl. ..... 200/6 R; 200/11 TC; 200/17 R

[58] Field of Search ..... 200/11 TC, 17, 18, 6 R

[56] References Cited

U.S. PATENT DOCUMENTS 1,796,076 3/1931 Blume et al. ..... 200/11 TC
1,931,869 10/1933 Jansen ..... 200/11 TC
1,985,927 1/1935 Jansen ..... 200/11 TC
3,400,231 9/1968 Bliebtrea ..... 200/11 TC
3,806,674 4/1974 Schaller ..... 200/11 TC X

*Primary Examiner*—James R. Scott
*Attorney, Agent, or Firm*—Watson, Cole, Grindle & Watson

[57] ABSTRACT

A diverter switch comprises at least two contact pairs, each pair having a fixed contact and a movable contact. The movable contacts are movably arranged on a pivoted current-carrying contact carrier. Each movable contact consists of two contact elements pressed by means of springs against the contact carrier on either side thereof. The current-carrying capacity of the movable contacts can be improved by means of silver plates arranged between the contact elements and the contact carrier.

4 Claims, 3 Drawing Figures

DIVERTER SWITCH FOR AN ON-LOAD TRANSFORMER TAP CHANGER

BACKGROUND OF THE INVENTION

1. Field of the Invention

The present invention relates to a diverter switch for an on-load transformer tap changer.

2. Prior Art

In diverter switches it is previously known to arrange the movable contacts supported by a link system movable between two end positions, in which the contact-carrying link arms are part of the transformer current circuit. Normally, either the movable or the fixed contact is arranged movable with respect to its contact carrier, so that the contact surfaces roll against each other upon making and breaking. In this way, among other things, the parts of the contact surfaces where arc foot points are formed are held separated from the parts of the contacts which are utilized as contact surfaces during normal operation. In previously known embodiments, the contact connection between the movably arranged contact and its contact carriers has been accomplished by means of stranded, flexible conductors, usually in the form of flat copper cords. Such cords, however, are expensive and relatively space-demanding.

SUMMARY OF THE INVENTION

The purpose of the present invention is to provide a diverter switch having at least two contact pairs with cooperating fixed and movable contacts, wherein the movable contacts are movably arranged on a current-carrying contact carrier and electrically connected thereto in a manner which provides good current-carrying capacity and which at the same time is less expensive and requires less space than previously known corresponding designs. This is attained by a new contact arrangement, wherein each movable contact comprises two contact elements arranged on opposite sides of the contact carrier and pressed thereagainst by means of springs. The contact elements and the contact carrier are provided with sliding contact surfaces facing each other for transmitting current between the contact elements and the contact carrier.

BRIEF DESCRIPTION OF THE DRAWING

An example of the switch according to the invention will be described in greater detail in the following with reference to the accompanying drawing, in which.

DESCRIPTION OF THE PREFERRED EMBODIMENT

Figure 1:
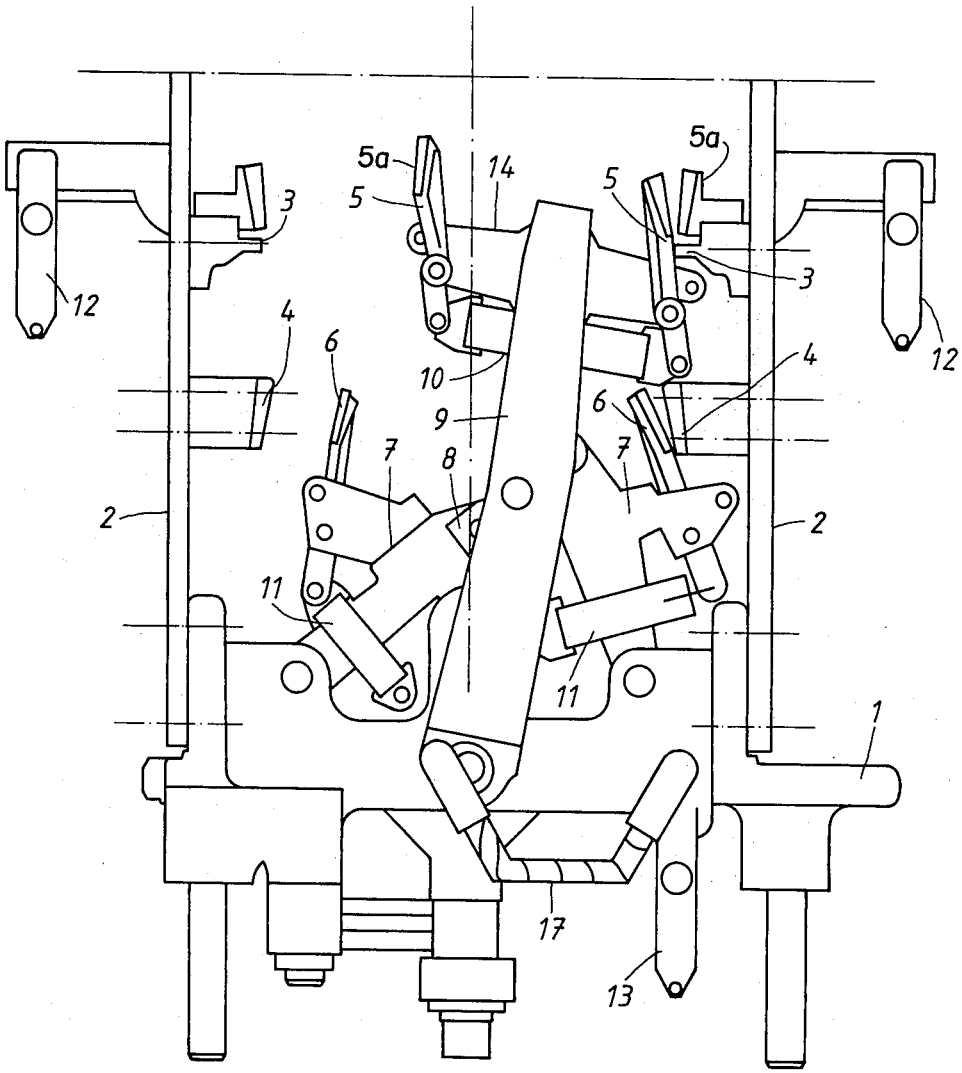
FIG. 1 shows a side view of a diverter switch.
Figure 2:
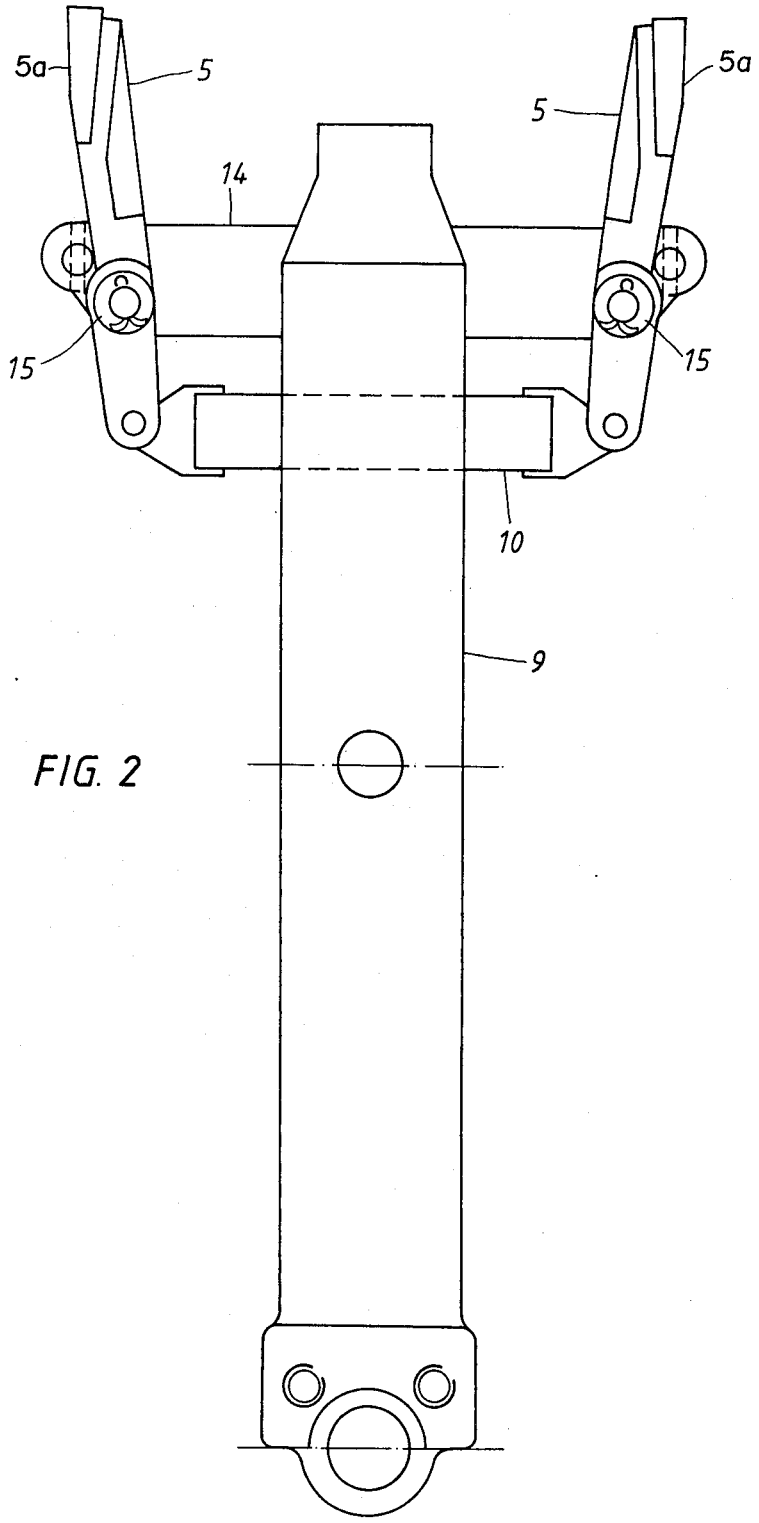
FIGS.2 and 3 show on an enlarged scale the movable main contact devices of the diverter switch for one phase seen from the side and from the front, respectively.

The diverter switch shown in the drawing is adapted to be included in an on-load tap changer for a transformer together with a step selector and an operating device. The diverter switch has a stand 1 of steel which supports insulating rods 2, on which are mounted on each side for each phase a fixed main contact 3 at the top and a fixed resistor contact 4 below this. The fixed contacts 3 and 4 cooperate with movable main contacts 5 and resistor contacts 6, respectively. At the top the contacts are provided with ferrules of arc-resistant material. The two movable resistor contacts 6 for each phase are each supported by a contact arm 7, which at their bottom are journalled in the stand 1 and at their top are joined together by a centre link 8 to a three-link polygon. The two movable main contacts 5 for each phase are supported by a contact arm 9, which at the bottom is journalled in the stand 1 between the bearing points for the resistor contact arms 7. The contact arm 9 is connected to the three-link polygon 7, 8 and is driven therefrom. The contact pressure springs for the main contacts are designated 10 and for the resistor contacts they are designated 11.

Switching of the diverter switch is performed by means of a spring battery (not shown), which is clamped between the centre link 8 and a spring tension arm journalled in the stand 1. Through the influence of a rotating shaft in the operating device, the spring tension arm is displaceable back and forth between a first and a second position, the diverter switch thus being rapidly switched over in a manner known per se (see, for example, British Pat. No. 755,589).

Each of the fixed main contacts 3 is connected, via connecting contacts 12, to one of the two movable selector contacts of the step selector. The fixed resistor contacts 4 are connected to the contacts 3 by way of a transition resistance. The movable contacts 5 and 6 are electrically connected to the stand 1, which in turn is connected to a conductor emanating from the transformer via a connecting contact 13.

Figure 3:
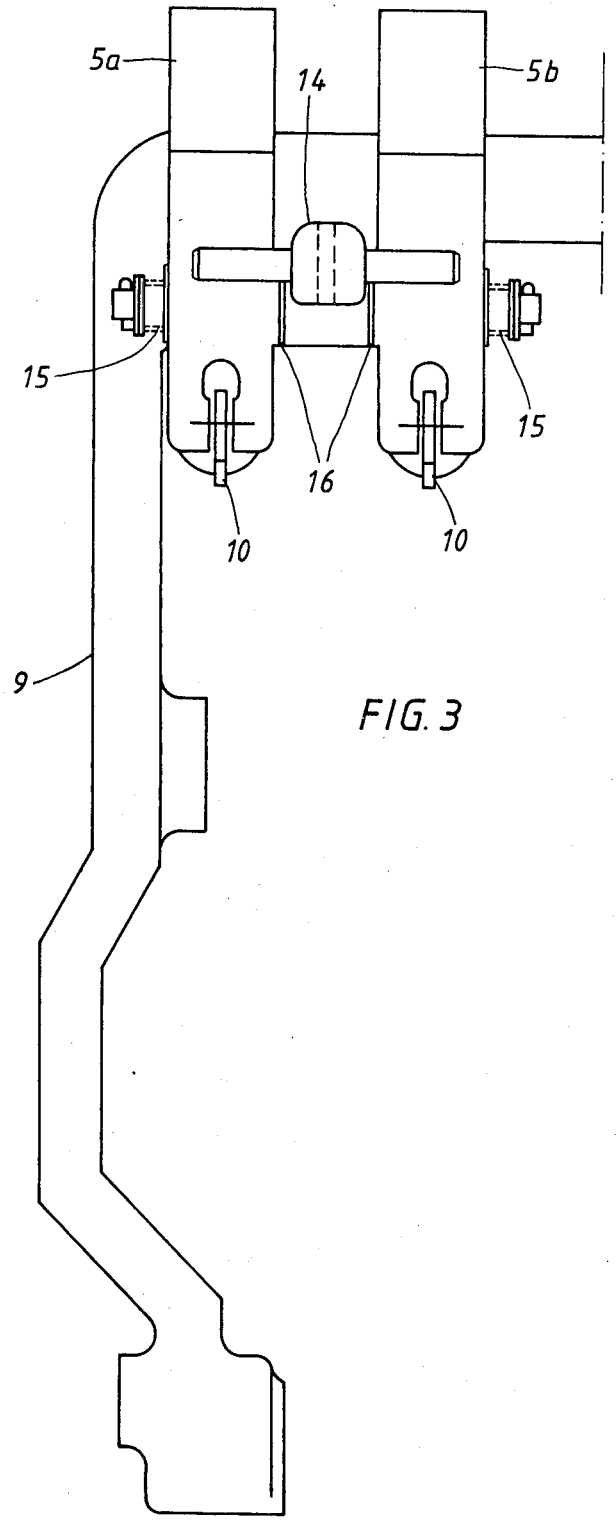

At the top the contact arm 9 is provided with a cross piece 14, the two ends of which each support one of the two movable main contacts 5. Each such contact comprises two contact elements **5*a* and 5*b* (FIG. 3), which are each arranged on one side of the cross piece 14 and are pressed against this by means of springs 15. Between the cross piece 14 and each of the contact elements 5*a*, 5*b*, a silver plate 16 is arranged for reducing the contact transition resistance. From the cross piece 14 the current passes via the contact arm 9 and a stranded conductor 17 to the stand 1**.

By the shown embodiment of the contact device of the diverter switch, a good contact connection is obtained between the movable contacts 5 and the contact arm 9 without using stranded copper conductors, which results in savings in costs and space compared with previously known corresponding devices. By arranging two contact elements on either side of the cross piece 14, a possible short-circuit current in the transformer will increase the contact pressure through the influence of the current forces, thus increasing the current-carrying capacity of the device.

What is claimed is:

1. A diverter switch for an on-load transformer tap changer, comprising a frame (1), an electrically-conducting, movable contact carrier (9,14) mounted on said frame, at least one first and one second contact pair, each of said contact pairs having a fixed contact (3) and a movable contact (5), said fixed contacts being mounted on said frame and said movable contacts being rotatably journalled on said contact carrier, operating means for moving said contact carrier between a first end position, in which said first contact pair is closed and said second contact pair is open, and a second end position, in which said first contact pair is open and said second contact pair is closed, and a first contact spring means (10) for generating contact pressure between the fixed and movable contacts of each respective contact pair when being closed, characterized in that each of said movable contacts comprises two contact elements (*5a*, *5b*), which are positioned on opposite sides of said contact carrier, that a second contact spring means (15) is provided for pressing said contact elements against said contact carrier, and that said contact elements and said contact carrier are provided with sliding contact surfaces facing each other for transmitting current between said contact elements and said contact carrier.

2. Diverter switch according to claim 1, wherein a plate (16) of highly conductive contact metal, preferably silver, is arranged between ech of said contact elements and said contact carrier.

3. Diverter switch according to claim 1, wherein said first contact spring means is connecting together the movable contact elements in one contact pair with the movable contact elements in the other contact pair.

4. Diverter switch according to claim 3, wherein the movable contact carrier (9, 14) consists of a current-carrying contact arm (9), which at one end is pivoted on said frame and at its other end is provided with a cross piece (14) extending on either side of said contact arm, each of the two ends of said cross piece supporting one of the movable contacts (5) of the two contact pairs.

* * * * *